United States Patent [19]

Taub

[11] 4,279,314

[45] Jul. 21, 1981

[54] RATCHET WRENCH ATTACHMENT

[76] Inventor: Darrel Taub, 6611 Woodley, Apt. 11, Van Nuys, Calif. 91406

[21] Appl. No.: 146,798

[22] Filed: May 5, 1980

[51] Int. Cl.[3] ..... E21B 3/00

[52] U.S. Cl. ..... 173/163; 185/10

[58] Field of Search ..... 173/163; 185/37, 38, 185/10; 81/57.39, 57.3, 51.4

[56] References Cited

U.S. PATENT DOCUMENTS 3,029,899 4/1962 Hutton ..... 185/37

FOREIGN PATENT DOCUMENTS 2741026 3/1979 Fed. Rep. of Germany ..... 185/10

*Primary Examiner*—Ronald Feldbaum

*Attorney, Agent, or Firm*—Matthew P. Lynch

[57] ABSTRACT

A releasable energy storing attachment to be used in conjunction with a ratchet wrench which is to operate a nut of a conventional nut and bolt assembly. The stored energy is to effect either tightening or loosening of the nut, whichever is desired. The attachment is designed primarily for use within confined quarter situations.

9 Claims, 4 Drawing Figures

10
12
24
54
28
14
16

3
42
26
32
28
38
34
36
40
44
30
46
54
52
48

24
22
12
20
18
14
16

24
36
28
10
38
44
26
32
34
40
54
48
52
30
46
20
10
32
28
36
50
40
52
48
26
34
54
44
30
46

RATCHET WRENCH ATTACHMENT

BACKGROUND OF THE INVENTION

The field of this invention relates to tools and more particularly to an energy storing attachment which produces actuation of a nut without operation of the ratchet wrench.

The ratchet wrench is an elongated tool which at one end thereof forms a handle and at the opposite end thereof comprises a coupling element in the form of a stud which is to connect with a socket which is to be rotated through operation of the wrench. The ratchet wrench includes internally some form of a ratchet or overrunning clutch.

A ratchet wrench inherently requires a substantial area of movement for the handle in order to apply the required torque in order to tighten or loosen a nut of a conventional nut and bolt assembly. At times, this wide area of movement for the handle is not available. For example, there may be a very limited amount of space for operation of the of ratchet wrench while working on an engine.

Previously this problem has been known. There have been attempts in the past to incorporate within the ratchet wrench structure itself some form of energy storing mechanism, which when activated causes the ratchet wrench to work in the normal manner without movement of the handle of the ratchet wrench. One disadvantage of such prior art devices is that the ratchet wrench is modified to be of a special configuration, thereby precluding the use of a conventional type of ratchet wrench. Also, a substantial amount of torque is usually required to effect tightening or loosening of a nut. The structure incorporated within the ratchet wrench is not capable of applying the torque that is required.

There is a need for an energy applying attachment to be used in conjunction with a ratchet wrench within confined quarters wherein the attachment is capable of supplying a substantial level of torque.

SUMMARY OF THE INVENTION

The structure of this invention relates to an attachment to be employed in combination with a conventional ratchet wrench. The housing is basically in the shape of a box with there being an access opening extending entirely through the housing. The access opening is polygonal shaped due to the locating therein of a socket sleeve which is in turn secured to a primary drive gear mounted within the internal chamber of the housing. The primary drive gear is connected through an idler gear to a secondary drive gear which is rotatably mounted within the internal compartment. A first spirally coiled flat spring is connected to the primary drive gear with a second spirally coiled flat spring being connected to the secondary drive gear. A movable pawl is connected to the secondary drive gear and permits the secondary drive gear as well as the primary drive gear to be rotated in only one direction. Rotation of the socket in this one direction results in compressing of the springs. When the movable pawl is released, each of the springs function to additively supply force to rotate the socket sleeve which is connected to a socket plug. The socket plug connects to a conventional socket which engages with the nut of a conventional bolt and nut assembly. The housing of the attachment includes a movable stop member which can be extended outwardly from the housing. The stop member is to abut against the ratchet wrench to prevent relative movement between the housing and the ratchet wrench during operation of the attachment.

DETAILED DESCRIPTION OF THE SHOWN EMBODIMENT

Figures 1, 2, 3, 4:
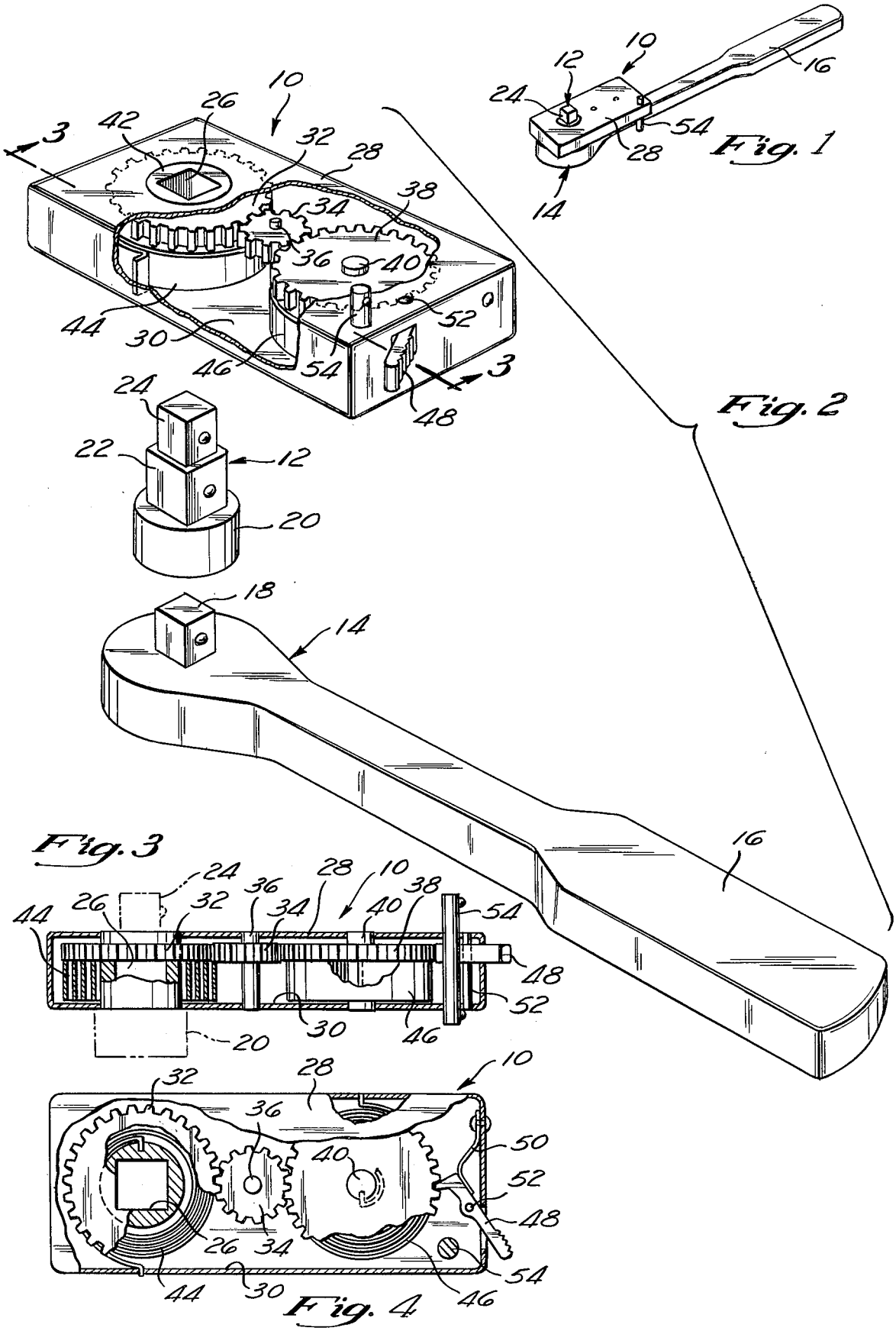
FIG. 1 is an overall isometric view showing the attachment of the present invention being mounted on a conventional ratchet wrench.
FIG. 2 is an exploded isometric view of the structure of FIG. 1.
FIG. 3 is a cross-sectional view through the attachment of this invention taken along line 3—3 of FIG. 2.
FIG. 4 is a partially, cut-away, top, plan view of the attachment of this invention.

Referring particularly to the drawing, there is shown the attachment 10 of this invention which is mounted by means of a socket plug 12 onto a conventional ratchet wrench 14. The ratchet 14 is an elongated tool having a graspable handle 16 and a polygonal shaped stud 18. Within the wrench 14 adjacent the stud 18 is a mechanism (not shown). Basically, the ratchet mechanism permits relative motion to occur between the stud 18 and the handle 16 in one direction. This particular direction is selected by means of a lever assembly (not shown). Torque is to be applied from the handle 16 to the stud 18 and then when the handle 16 is moved in the reverse direction it ratchets. Then torque is reapplied to the stud 18.

Socket plug 12 is divided into three integrally connected sections, a lower section 20, a middle section 22 and an upper section 24. The upper section 24 is basically identical to the stud 18 in size and shape. The middle section 22 is adapted to matingly interfit with the polygonal shaped opening 26 in a socket sleeve 42. The lower section 20 includes an internal recess (not shown) which is to matingly connect with the stud 18. The purpose of the socket plug 12 is to employ the use of the attachment 10.

The attachment 10 is formed of a box-like housing 28 which has an internal compartment 30. Rotatably supported within the internal compartment 30 is the primary drive gear 32. The socket sleeve 42 is centrally located within the primary drive gear 32. The primary drive gear 32 is operatively connected to an idler gear 34 which is pivotally mounted by means of shaft 36 to the housing 28. Also operatively connected to the idler gear 34 is a secondary drive gear 38 which is rotatably mounted with respect to the housing 28 by means of a shaft 40. The secondary drive gear 38 is of the same type, same size and has the same number of gear teeth as the primary drive gear 32. Upon rotational movement of the primary drive gear 32, the secondary drive gear will be rotated in the same direction and at the same speed.

The primary drive gear 32 is fixedly mounted on the socket sleeve 42. Located about the sleeve 42 is a spirally coiled flat spring 44. One end of the spirally coiled flat spring 44 is fixedly secured onto the sleeve 42 with the opposite end of the spring 44 being fixedly secured to the housing 28.

In a similar manner, a spirally coiled flat spring 46 is connected between the housing 28 and the shaft 40 which is fixedly secured to the secondary drive gear 38.

Applying rotational torque in the clockwise direction through socket member 12 to the sleeve 42 causes the primary drive gear 32 to also be rotated clockwise. At the same time, the secondary drive gear 38 is rotated clockwise. The rotational movement of the gears 32 and 38 causes the compressing or winding of the respective springs 44 or 46. Applying of the torque to the sleeve 42 is accomplished by means of the ratchet wrench 14. Normally, this applying of torque will continue until the springs 44 and 46 are tightly wound.

In order to prevent the springs 44 and 46 from unwinding until such is desired, a movable pawl 48 is to operatively engage the secondary drive gear 38. The movable pawl 48 is continuously biased toward engagement with the secondary drive gear 38 by means of a leaf spring 50 which is attached to the side wall of the compartment 30. The movable pawl is mounted on a pivot pin 52. The movable pawl 48 ratchets during winding of the coil springs 44 and 46. After the coil springs 44 and 46 are completely wound by manual movement of the movable pawl 48 against the bias of the spring 50, disengaging the movable pawl 48 from the secondary drive gear 38 results in the forces of the springs 44 and 46 being additively supplied to the sleeve 42. During this time, if the ratchet wrench 14 is connected to the attachment 10 as shown within FIG. 1, the stud 18 will be ratcheted with respect to the handle 16 so as to not hinder the rotational movement of the sleeve 42. The rotational movement of the sleeve 42 is transmitted through socket plug 12 and through the stud 24 to a conventional socket (not shown) which in turn is connected to a nut of a conventional bolt and nut assembly, again not shown.

When the attachment 10 is mounted on the ratchet wrench 14, it is desired that upon use of the attachment 10, that such will remain fixed with respect to the ratchet wrench 14. In order to accomplish this, there is employed a pin 54 which is to function as a stop and abut against the handle 16 of the ratchet wrench 14. This pin 54 is slidably mounted within an appropriate opening formed within the housing 28. The ends of the pin 54 are slightly enlarged so as to prevent disengagement of the pin 54 from the housing 28.

It is to be noted that the pin 54 can be moved to be extended from either side of the housing. The reason for this is that the attachment 10 can be reversed with respect to the socket plug 12. When the attachment 10 is so reversed, the sleeve 42 will be rotated in the counter clockwise direction. The net result is that the clockwise direction would be used for tightening of a nut and the counter clockwise direction would be for removing a nut.

What is claimed is:

1. An attachment to be used in conjunction with a ratchet wrench comprising:

a housing having an internal compartment, an access opening formed within said housing connecting with said internal compartment;

a primary drive gear rotatably mounted within said internal compartment, said primary drive gear having a socket opening centrally located within said primary drive gear, said socket opening connecting with said access opening;

a secondary drive gear rotatably mounted within said internal compartment, said secondary drive gear being operatively connected through an idler gear to said primary drive gear;

a spring assembly connected to both said primary and said secondary drive gears, said spring assembly being windable by rotating said socket opening, said socket opening to connect with a socket plug, said spring assembly to cause rotation of said socket plug; and a movable pawl mounted on said housing and located within said internal compartment, said movable pawl being movable between an engaging position and a disengaging position, said engaging position connecting said movable pawl with one of said drive gears and preventing rotation of said socket opening by said spring assembly.

2. The attachment as defined in claim 1 wherein:

said access opening extending entirely through said housing thereby being accessible from either the front side of said housing or the back side of said housing.

3. The attachment as defined in claim 1 wherein:

said spring assembly comprises two separate springs, one of said springs being attached to said primary drive gear and the other of said springs being attached to said secondary drive gear.

4. The attachment as defined in claim 1 wherein:

said movable pawl being continuously biased toward said engaging position.

5. The attachment as defined in claim 1 including:

a stop member connected to said housing and extending outwardly therefrom, said stop member being adapted to abut a ratchet wrench to thereby prevent relative rotation between said ratchet wrench and said housing.

6. The attachment as defined in claim 5 wherein:

said stop member being movably mounted with respect to said housing.

7. The attachment as defined in claim 6 wherein:

said access opening extending entirely through said housing thereby being accessible from either the front side of said housing or the back side of said housing.

8. The attachment as defined in claim 7 wherein:

said spring assembly comprises two separate springs, one of said springs being attached to said primary drive gear and the other of said springs being attached to said secondary drive gear.

9. The attachment as defined in claim 8 wherein:

said movable pawl being continuously biased toward said engaging position.

* * * * *